US010473342B1

(12) United States Patent
Davidson

(10) Patent No.: US 10,473,342 B1
(45) Date of Patent: Nov. 12, 2019

(54) DAVIT SYSTEM FOR SERVICING AN AIR CONDITIONING UNIT

(71) Applicant: Glen Davidson, Riverside, CA (US)

(72) Inventor: Glen Davidson, Riverside, CA (US)

( * ) Notice: Subject to any disclaimer, the term of this patent is extended or adjusted under 35 U.S.C. 154(b) by 89 days.

(21) Appl. No.: 15/623,864

(22) Filed: Jun. 15, 2017

(51) Int. Cl.

| | |
|---|---|
| ***F16M 11/18*** | (2006.01) |
| ***F16M 13/02*** | (2006.01) |
| ***F16J 13/18*** | (2006.01) |
| ***F24F 1/22*** | (2011.01) |
| ***F24F 1/26*** | (2011.01) |
| ***F24F 1/34*** | (2011.01) |

(52) U.S. Cl.
CPC ..... *F24F 1/22* (2013.01); *F24F 1/26* (2013.01); *F24F 1/34* (2013.01)

(58) Field of Classification Search
CPC ..... B66C 23/022; F24F 1/22; F16M 13/022; F16M 11/18; F16J 13/18
USPC .... 52/36.4, 36.5, 36.6; 220/290, 582, 23.91, 220/252
See application file for complete search history.

(56) References Cited

U.S. PATENT DOCUMENTS

| | | | | |
|---|---|---|---|---|
| 1,746,109 | A | 2/1930 | Edwards | |
| 2,509,950 | A * | 5/1950 | Zierke | B60P 1/5433 212/202 |
| 3,166,285 | A * | 1/1965 | Downes | A47B 57/565 248/245 |
| 4,661,091 | A * | 4/1987 | Moen | B31B 50/00 271/10.14 |
| 6,499,610 | B2 | 12/2002 | Spitsbergen | |
| 2002/0084275 | A1* | 7/2002 | Pysher | F16J 13/20 220/327 |
| 2003/0163958 | A1* | 9/2003 | Zeh | A47B 83/001 52/36.5 |
| 2009/0000235 | A1* | 1/2009 | Kieran | E04B 1/24 52/656.9 |
| 2009/0127424 | A1* | 5/2009 | Ly | E04G 3/34 248/544 |
| 2010/0044379 | A1* | 2/2010 | Asterlin | F16J 13/22 220/324 |
| 2015/0266709 | A1* | 9/2015 | Tygard | B66F 9/183 414/623 |
| 2016/0281909 | A1* | 9/2016 | Grant | B66C 23/022 |
| 2016/0363393 | A1* | 12/2016 | Wolfgram | F28F 9/0219 |
| 2016/0376822 | A1* | 12/2016 | Volin | E05D 5/06 49/396 |

* cited by examiner

*Primary Examiner* — Jianying C Atkisson
*Assistant Examiner* — Meraj A Shaikh
(74) *Attorney, Agent, or Firm* — Eric Karich; Karich & Associates

(57) ABSTRACT

A davit system has a davit arm and a davit mount. The davit mount includes a mount body, a clamping mechanism for clamping the corner flange of the air conditioning unit, and an arm mounting element for pivotally mounting the davit arm on the davit mount. When the mount body is mounted on the corner flange of the air conditioning unit, the davit arm extends laterally over the head of the air conditioning unit, and pivots away from the air conditioning unit for removing the head during servicing.

8 Claims, 3 Drawing Sheets

DAVIT SYSTEM FOR SERVICING AN AIR CONDITIONING UNIT

BACKGROUND OF THE INVENTION

Field of the Invention

This invention relates generally to davit systems, and more particularly to a portable davit system that is adapted to be used for servicing air conditioning systems.

Description of Related Art

Davit systems (i.e., davit cranes and similar devices) are known in the art of lifting devices, and are particularly used on ships for raising and lowering lifeboats. Edwards, U.S. Pat. No. 1,746,109, for example, teaches a boat davit for lifting life vessels from a ship.

Davit systems are also used in other fields. Spitsbergen, U.S. Pat. No. 6,499,610, for example, teaches a portable davit that may be mounted in the bed of a truck for lifting items into the bed of the truck.

The prior art teaches davit cranes for lifting items. However, the prior art does not teach a portable davit system that may be temporarily mounted on an air conditioning system (i.e., on a condenser or evaporator) for servicing the air conditioner. The present invention fulfills these needs and provides further advantages as described in the following summary.

SUMMARY OF THE INVENTION

The present invention teaches certain benefits in construction and use which give rise to the objectives described below.

The present invention provides a davit system for removing a head from an air conditioning unit. The davit system includes a davit arm and a davit mount. The davit mount includes a mount body, a clamping mechanism for clamping the corner flange, and an arm mounting element for removably and pivotally mounting the davit arm on the davit mount. When the mount body is mounted on the corner flange of the air conditioning unit, the davit arm extends laterally over the head of the air conditioning unit, and pivots away from the air conditioning unit for removing the head during servicing.

A primary objective of the present invention is to provide a davit system having advantages not taught by the prior art.

Another objective is to provide a davit system that is small enough to be moved and installed by a single person, for rapid and efficient servicing of the air conditioning units.

A further objective is to provide a davit system that includes a mount that is adjustable to fit a variety of air conditioning units.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a davit system 10 for removing a head 12 from an air conditioning unit 14 for servicing the air conditioning unit 14.

Figure 1:
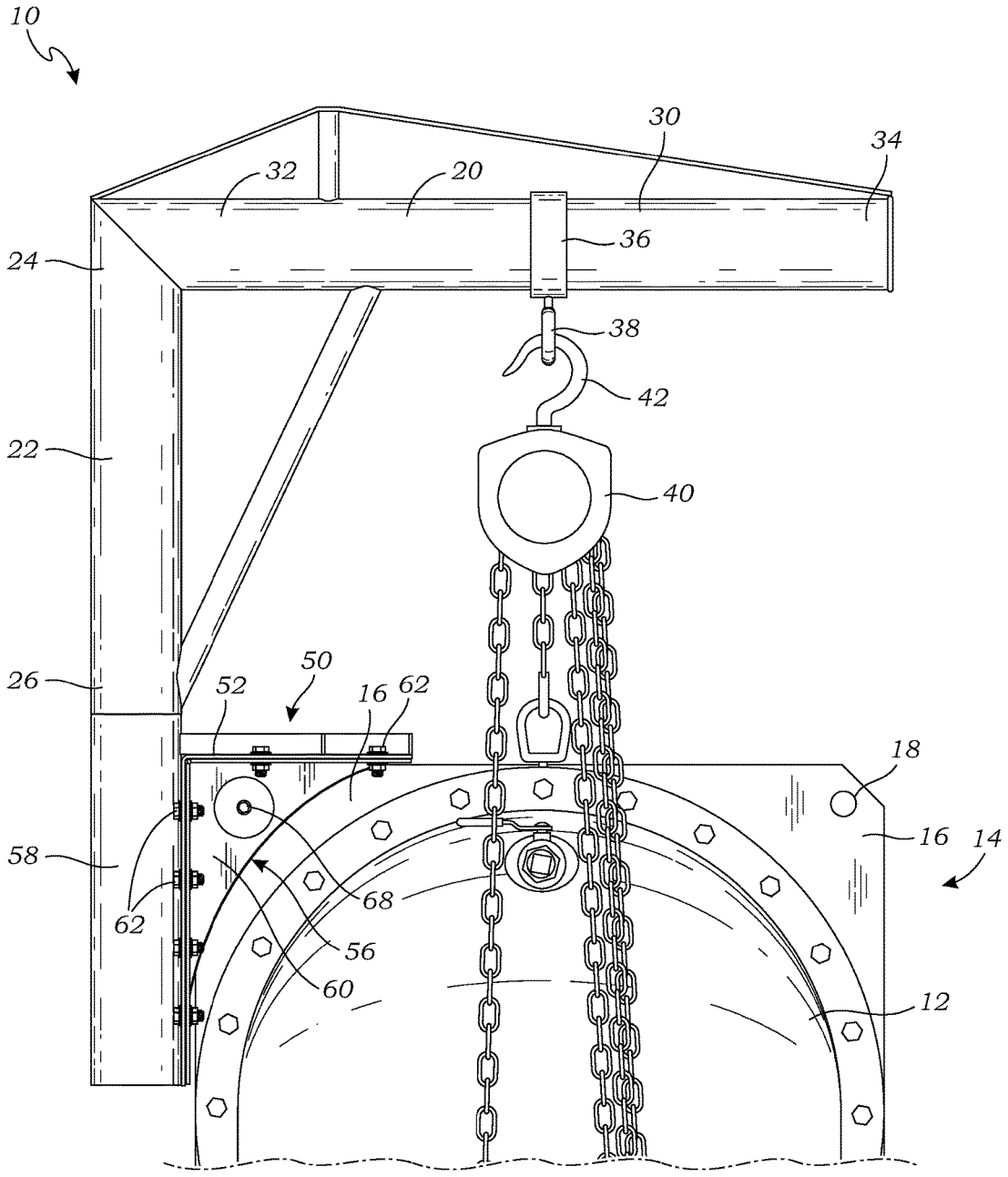
FIG. 1 is a perspective view of a davit system according to one embodiment of the present invention, illustrating the davit system mounted on an air conditioning unit, the davit system including a davit arm and a davit mount.
Figure 2:
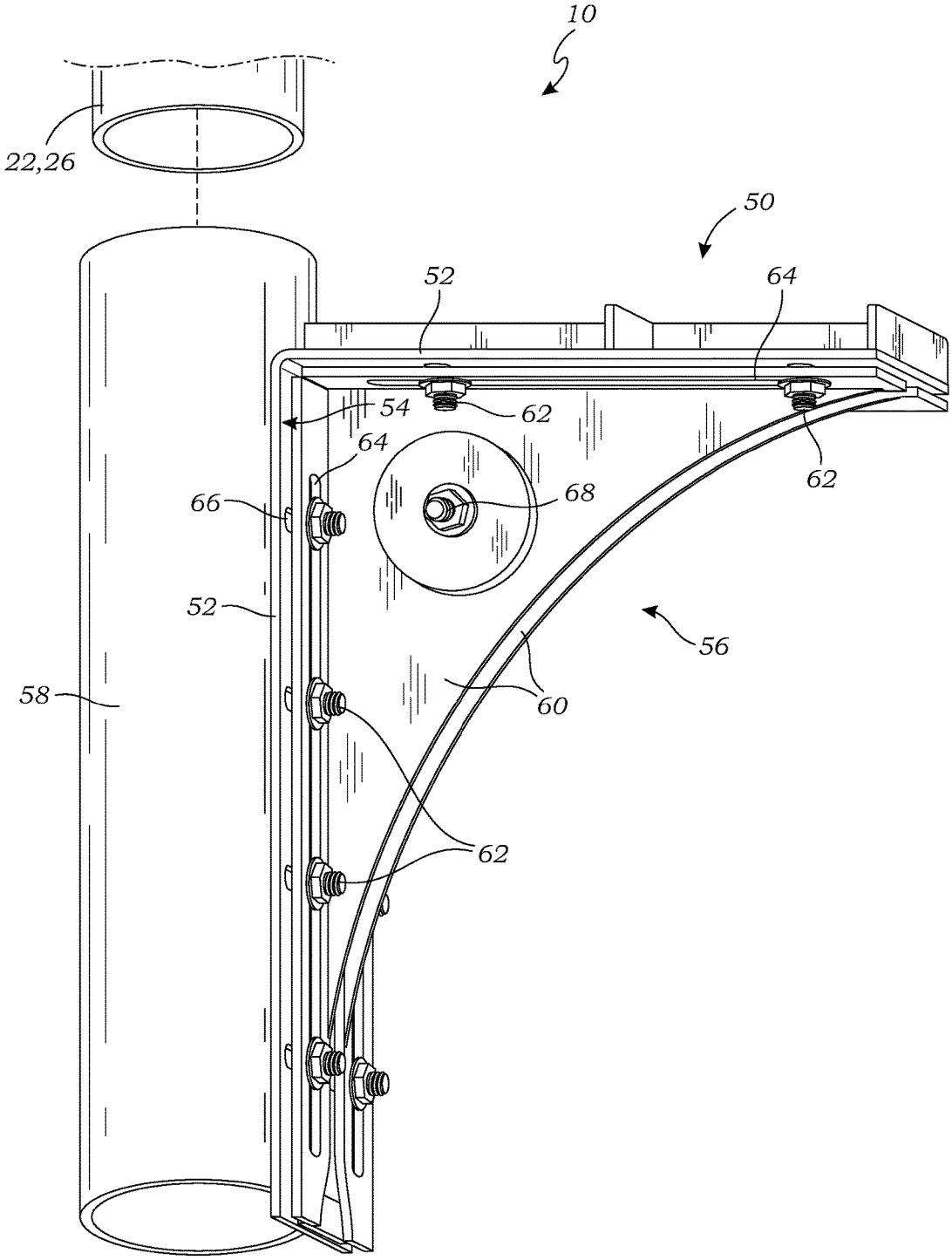
FIG. 2 is a perspective view of the davit mount, and illustrating the davit arm removed from an arm mounting element of the davit mount.

FIG. 1 is a perspective view of a davit system 10 according to one embodiment of the present invention, illustrating the davit system 10 mounted on an air conditioning unit 14. As shown in FIG. 1, the davit system 10 includes the combination of a davit arm 20 and a davit mount 50. FIG. 2 is a perspective view of the davit mount 50, and illustrating the davit arm 20 removed from an arm mounting element 58 of the davit mount 50. As shown in FIG. 2, the davit arm 20 is readily removably from the davit mount 50, enabling the two components to be easily portable by a single person. This also facilitates installation, wherein the single person can mount the davit mount 50 onto the air conditioning units 14, and then operably mount the davit arm 20 on the davit mount 50.

As shown in FIGS. 1-2, the air conditioning unit 14 has corner flanges 16 adjacent the head 12, and the corner flanges 16 each have a flange hole 18 therethrough. One of these corner flanges 16 may be used for installing the davit system 10. The davit mount 50 includes a clamping mechanism 56, discussed in greater detail below, which enables the davit mount 50 to be removably installed on the corner flange 16.

The davit arm 20 is then mounted on the davit mount 50 for supporting the head 12 of the air conditioning unit 14 for removing the head 12 from the air conditioning unit 14 during maintenance. The davit arm 20 is adapted to removably engage the davit mount 50, and extends to an attachment point 36 that is adapted to be removably attached to the head 12 of the air conditioning unit 14. This enables the head 12 to be moved, at which time the davit system 10 supports the substantial weight of the head 12, and enables it to be moved out of the way (i.e., by pivoting the davit arm 20) for servicing the air conditioning unit 14.

In the embodiment of FIGS. 1-2, the davit arm 20 includes a vertical post 22 having a top end 24 and a bottom end 26; and a horizontal post 30 that extends from an inner end 32 that is attached to the top end 24 of the vertical post 22, to an outer end 34. The attachment point 36 may be provided on the horizontal post 30. In this embodiment, the attachment point 36 is in the form of an annular slider that is slidably mounted on the horizontal post 30. The annular slider may include an attachment ring 38 for removably engaging a hook 42 of a chain hoist 40, which may be used to attach to and lift the head 12.

For purposes of this application, the term "removably attached" is defined to mean that a single person may attach or remove a component with either no tools, or the use of only wrenches and similar manual hand tools, in a very short period of time (e.g., typically in seconds, up to a couple of minutes at most), without breaking any parts of any components, or otherwise damaging the system.

As shown in FIGS. 1-2, the davit mount 50 comprises a mount body 52, which provides a strong, rigid base (e.g., steel, or similar material), and may have a generally L-shaped. In this embodiment, the mount body 52 has an inner surface 54 shaped to abut the corner flange 16 of the air conditioning unit 14. The clamping mechanism 56 is positioned on the inner surface 54 of the mount body 52 for clamping the corner flange 16 of the air conditioning unit 14. An arm mounting element 58 may be mounted on the mount body 52, opposite the clamping mechanism 56, for pivotally mounting the davit arm 20 on the davit mount 50. This construction is such that when the mount body 52 is mounted on the corner flange 16 of the air conditioning unit 14 with the clamping mechanism 56, the davit arm 20 is positioned to extend laterally over the head 12 of the air conditioning unit 14, and may be pivoted away from the air conditioning unit 14.

Figure 3:
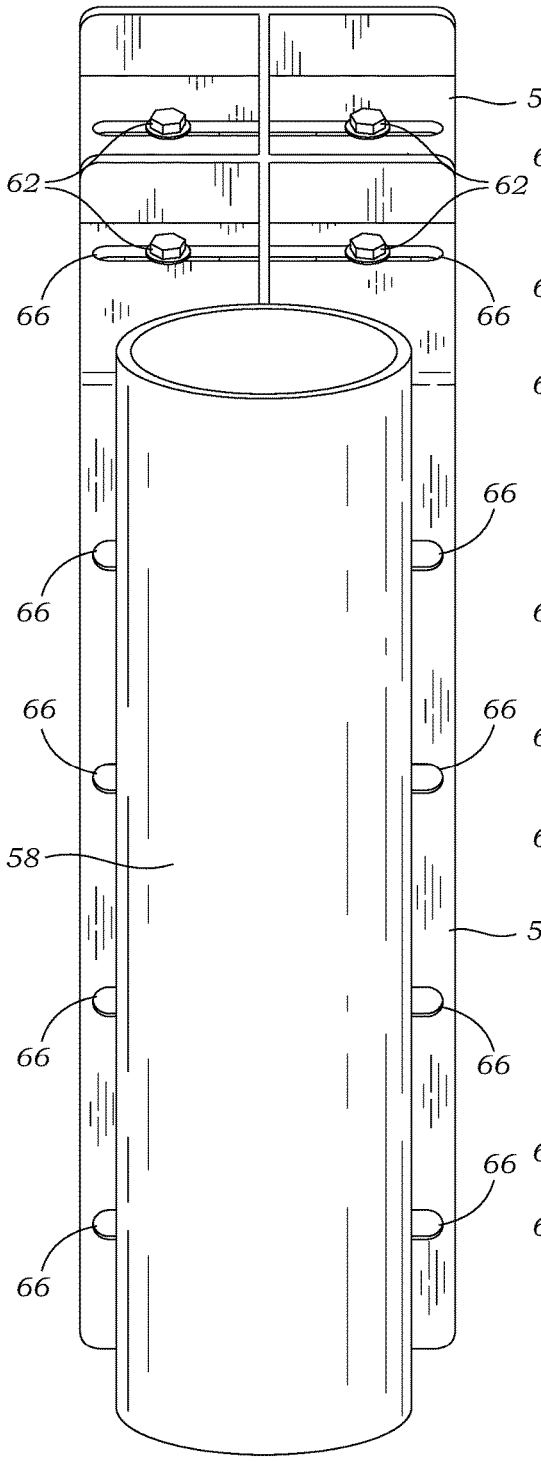
FIG. 3 is a left side elevational view of the davit mount, showing the arm mounting element.

FIG. 3 is a left side elevational view of the davit mount 50, showing the arm mounting element 58. As shown in FIGS. 1-3, in this embodiment, the arm mounting element 58 is a cylindrical receiver welded to the mount body 52 opposite the clamping mechanism 56. The cylindrical receiver is shaped to slidably receive the vertical post 22 of the davit arm 20, such that the davit arm 20 is able to pivot within the cylindrical receiver.

Figure 4:
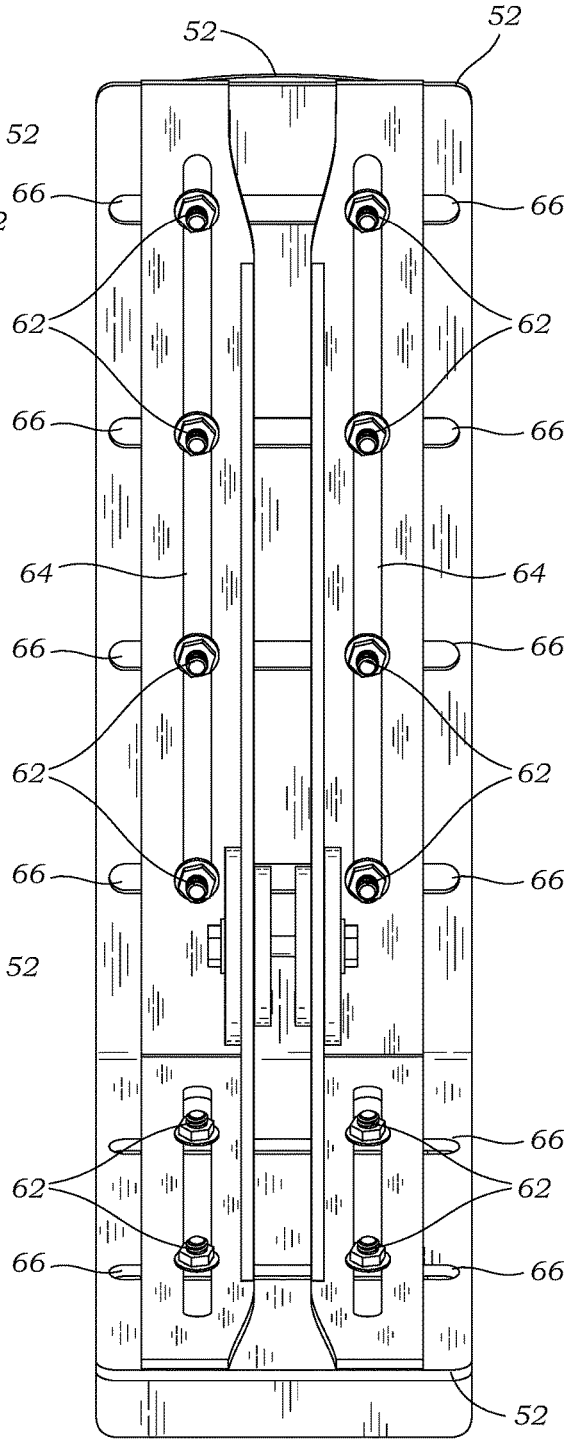
FIG. 4 is a right side elevational view of the davit mount, showing a clamping mechanism used to mount the mount body on the air conditioning unit.

FIG. 4 is a right side elevational view of the davit mount 50, showing one embodiment of the clamping mechanism 56 used to mount the mount body 52 on the air conditioning unit 14. As shown in FIGS. 1-4, in this embodiment, the clamping mechanism 56 includes a pair of clamping plates 60 that are slidably mounted on the davit mount 50 with a plurality of bolts 62 through first slots 64 in the clamping plates 60, and second slots 66 in the davit mount 50, and which may be locked in a clamping position by tightening the plurality of bolts 62. The first slots 64 are perpendicular to the second slots 66, such that the clamping plates 60 may be adjusted in all directions, until the plurality of bolts 62 are tightened to lock the clamping plates 60 into position (thereby clamping the davit mount 50 on the flange of the air conditioning unit 14).

As shown in FIGS. 1, 2, and 4, the clamping mechanism 56 may further comprise a traverse bolt 68 that extends through the pair of clamping plates 60. In operation, the traverse bolt 68 extends through the flange hole 18 of the air conditioning unit 14, further locking the davit mount 50 onto the air conditioning unit 14.

While one embodiment of the clamping mechanism 56 is illustrated and discussed above, the term clamping mechanism 56 further includes similar and equivalent clamping mechanisms 56 known in the art, which may be used as described herein, and such alternatives should be considered within the scope of the present invention, unless expressly required in the following claims.

The invention further includes a method for removing a head 12 from an air conditioning unit 14 for servicing the air conditioning unit 14 using the davit system 10 described above. The method comprising the steps of providing the davit system 10 described above, or an equivalent system. The davit mount 50 is positioned on the corner flange 16 of the air conditioning unit 14, and clamped in place using the clamping mechanism 56. The davit arm 20 is then pivotally mounted on the arm mounting element 58, such that the davit arm 20 extends laterally over the head 12 of the air conditioning unit 14, and can pivot away from the air conditioning unit 14.

A connector such as the chain hoist 40 discussed above, or another form of cable, chain, lift, etc., may be used to attach the head 12 to the connector point of the davit arm 20. The head 12 may then be removed (i.e., unbolted) from the air conditioning unit 14, and the connector and the davit system 10 support the weight of the head 12. The head 12 may be moved out of the way by pivoting the davit arm 20 on the davit mount 50, until the maintenance is complete and the head 12 is re-mounted on the air conditioning unit 14.

Following service, the davit arm 20 may be easily removed from the davit mount 50, and the davit mount 50 may then be removed from the air conditioning unit 14, and moved to another air conditioning unit 14 for maintaining further units.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by the following claims.

What is claimed is:

1. A davit system for removing a head from an air conditioning unit for servicing the air conditioning unit, the air conditioning unit having a corner flange adjacent the head, the corner flange having a flange hole therethrough, the davit system comprising:

a davit arm; and a davit mount comprising:

an L-shaped mount body shaped to abut the corner flange of the air conditioning unit;

a pair of clamping plates mounted on the L-shaped mount body for clamping the corner flange of the air conditioning unit therebetween;

a traverse bolt that extends through the pair of clamping plates and adapted to pass through the flange hole of the air conditioning unit; and a cylindrical arm mounting element mounted on the L-shaped mount body, the cylindrical arm mount element being shaped for removably and pivotally mounting the davit arm on the davit mount.

2. The davit system of claim 1, wherein the davit arm comprises: a vertical post having a top end and a bottom end; and a horizontal post that extends from an inner end that is attached to the top end of the vertical post, to an outer end.

3. The davit system of claim 2, wherein the davit arm further comprises an attachment point slidably mounted on the horizontal post.

4. The davit system of claim 3, further comprising a chain hoist attached to the attachment point of the horizontal post.

5. The davit system of claim 3, wherein the arm mounting element is a cylindrical receiver shaped to slidably receive the vertical post of the davit arm, and such that the davit arm is able to pivot within the cylindrical receiver.

6. The davit system of claim 1, wherein the pair of clamping plates are slidably mounted on the davit mount with a plurality of bolts through first slots in the clamping plates, and second slots in the davit mount, and which is locked in a clamping position by tightening the plurality of bolts.

7. A davit system for removing a head from an air conditioning unit for servicing the air conditioning unit, the air conditioning unit having a corner flange adjacent the head, the corner flange having a flange hole therethrough, the davit system comprising:

a davit arm; and a davit mount comprising:

an L-shaped mount body shaped to abut the corner flange of the air conditioning unit;

a pair of clamping plates mounted on the L-shaped mount body for clamping the corner flange of the air conditioning unit therebetween;

wherein the clamping plates are slidably mounted on the davit mount with a plurality of bolts through first slots in the clamping plates, and second slots in the davit mount, and which is locked in a clamping position by tightening the plurality of bolts;

a traverse bolt that extends through the pair of clamping plates and adapted to pass through the flange hole of the air conditioning unit; and a cylindrical arm mounting element mounted on the L-shaped mount body, the cylindrical arm mount element being shaped for removably and pivotally mounting the davit arm on the davit mount.

8. A method for removing a head from an air conditioning unit for servicing the air conditioning unit, the air conditioning unit having a corner flange adjacent the head, the corner flange having a flange hole, the method comprising the steps of:

providing a davit system comprising:

a davit arm; and a davit mount comprising:

an L-shaped mount body shaped to abut the corner flange of the air conditioning unit;

a pair of clamping plates mounted on the L-shaped mount body for clamping the corner flange of the air conditioning unit therebetween;

a traverse bolt that extends through the pair of clamping plates and adapted to pass through the flange hole of the air conditioning unit; and a cylindrical arm mounting element mounted on the L-shaped mount body, the cylindrical arm mount element being shaped for removably and pivotally mounting the davit arm on the davit mount;

positioning the davit mount on the corner flange of the air conditioning unit, such that the clamping plates are on either side of the corner flange;

inserting the traverse bolt through both of the clamping plates and through the flange hole of the corner flange, to lock the davit mount on the air conditioning unit so that the davit mount is supported by the air conditioning unit;

pivotally mounting the davit arm on the arm mounting element, such that the davit arm extends laterally over the head of the air conditioning unit;

attaching the head of the air conditioning unit to the davit arm; and disconnecting the head from the air conditioning unit so that the head is entirely supported by the davit arm.

* * * * *